US009951463B2

(12) United States Patent
McLoughlin et al.

(10) Patent No.: US 9,951,463 B2
(45) Date of Patent: Apr. 24, 2018

(54) GARMENT BAG CONFIGURED TO FACILITATE QUICK DRYING OF CLOTHES

(71) Applicants: Loi McLoughlin, Vernon Hills, IL (US); Le Phung, Lake Grove, NY (US)

(72) Inventors: Loi McLoughlin, Vernon Hills, IL (US); Le Phung, Lake Grove, NY (US)

( * ) Notice: Subject to any disclaimer, the term of this patent is extended or adjusted under 35 U.S.C. 154(b) by 184 days.

(21) Appl. No.: 14/876,444

(22) Filed: Oct. 6, 2015

(65) Prior Publication Data

US 2016/0281289 A1 Sep. 29, 2016

Related U.S. Application Data

(63) Continuation-in-part of application No. 14/671,398, filed on Mar. 27, 2015, now Pat. No. 9,764,512.

(51) Int. Cl.

| | |
|---|---|
| ***D06F 58/14*** | (2006.01) |
| ***A45C 3/00*** | (2006.01) |
| ***A45C 15/00*** | (2006.01) |

(52) U.S. Cl.

CPC ..... *D06F 58/14* (2013.01); *A45C 3/004* (2013.01); *A45C 15/00* (2013.01)

(58) Field of Classification Search

CPC ..... D06F 58/14; A45C 13/00
USPC ..... 206/278
See application file for complete search history.

(56) References Cited

U.S. PATENT DOCUMENTS

| | | | | |
|---|---|---|---|---|
| 2,975,529 | A * | 3/1961 | Weber | A47K 10/06 206/216 |
| 3,264,755 | A * | 8/1966 | Moore | D06F 58/14 206/216 |
| 5,829,162 | A * | 11/1998 | Pace | D06F 58/14 34/202 |
| 5,996,249 | A * | 12/1999 | Manning | D06F 58/14 34/202 |
| 6,757,986 | B2 * | 7/2004 | Miller | A45C 9/00 34/132 |
| D499,548 | S * | 12/2004 | Deutschendorf | D3/278 |
| 8,714,350 | B2 * | 5/2014 | Berglund | B65D 33/12 206/278 |
| 2008/0184590 | A1 * | 8/2008 | Lozano | D06F 58/14 34/622 |
| 2010/0083531 | A1 * | 4/2010 | Hu | D06F 58/14 34/565 |

* cited by examiner

*Primary Examiner* — Sue A Weaver
(74) *Attorney, Agent, or Firm* — Louise S. Heim

(57) ABSTRACT

Portable clothes-drying assemblies are provided to allow travelers to quickly and easily dry articles of clothing. In one embodiment of the invention, the assembly includes a specially configured garment bag from which a conventional hand held hair dryer is suspended. The garment bag includes a pair of exterior side walls defining a clothing compartment, an inlet opening configured to direct heated air from the dryer to a heated air chamber inside the bag, and a baffle system for ensuring that the warm or hot air in the heated air chamber is distributed evenly throughout the clothing compartment.

14 Claims, 3 Drawing Sheets

GARMENT BAG CONFIGURED TO FACILITATE QUICK DRYING OF CLOTHES

CROSS-REFERENCE TO RELATED APPLICATIONS

This application is a continuation-in-part of U.S. patent application Ser. No. 14/671,388, filed Mar. 27, 2015.

BACKGROUND

Field of the Invention

This invention relates to clothes drying systems.

More specifically, the invention relates to portable systems for drying articles of clothing during travel.

In a further and more specific aspect, the invention concerns garment bags configured to facilitate quick drying of clothes during travel.

Background of the Invention

Business and recreational travelers often prefer to "travel light" and bring only a few items of clothing with them when on the road. For instance, an individual may choose to bring along two or three sets of casual clothes for everyday use, and a single set of dress clothes for going out on a special occasion. When any one of these articles of clothing gets soiled, the traveler will typically hand wash it and then either hang it out to air-dry or blow it dry with a conventional hand-held hair-dryer. However, air-drying can take several hours, while blow-drying with a conventional hair dryer requires the use of one or both hands, making it very inconvenient for the time-pressed traveler. Accordingly, there exists a need for portable devices allowing quick, hands-free clothes drying.

SUMMARY

Briefly, to achieve the desired objects of the present invention in accordance with the preferred embodiment thereof, assemblies are provided for converting conventional hand-held, blower-type hair driers into hands-free portable clothes driers. An assembly includes a hair dryer with a nozzle, a mounting arrangement configured to mounting the hair dryer in the vicinity of an article of clothing, an adapter for extending the effective length of the nozzle and directing heated air from the nozzle to the clothing, and a baffle system downstream of said inlet opening and configured to distribute heated air substantially evenly throughout the clothing compartment.

In one exemplary embodiment of the invention, the mounting arrangement comprises a garment bag having a pair of side walls defining a clothing compartment. An inlet for receiving heated air from the hair dryer is provided at one end of the bag, and at least one exhaust opening is provided at the opposite end of the bag. An attachment system is provided for suspending the dryer from the end of the bag proximate the inlet. The adapter comprises a tubular member having a proximal end in fluid communication with the end of the hair dryer nozzle and its distal end in fluid communication with an inlet opening formed at the bottom of the garment bag. An intermediate wall downstream of the inlet opening separates the inlet opening from the clothing compartment and defines a heated air chamber in which warm or hot air from the dryer collects before exiting through a baffle system.

In another preferred embodiment of the invention, the mounting means consists of a pair of flexible straps for suspending the dryer from a horizontal rod. The adapter comprises a tubular member having its proximal end securable to the end of the hair dryer nozzle and its distal end configured to be inserted into an article of clothing suspended from the same horizontal rod as the dryer. A plurality of flexible distributor tubes extending through the tubular member serve as the baffle system. Each of these distribution tubes comprises a proximal end, a distal end, and an elongated intermediate portion formed of a porous material such as cloth, or a nonporous material having perforations or apertures through which heated air can escape. The proximal ends of the tubes are retained in a retention disk positioned downstream of the proximal end of the adapter, whereby the space between the retention disk and the proximal end of the adapter defines a heated air chamber in which warm or hot air from the dryer collects before distribution through the tubes.

An alternate version of the invention allows a conventional blow dryer to be used as-is, without the need for a separate adapter to be secured to its nozzle. Instead, the adapter is built into the garment bag itself, in the form of a elongated tube extending downwardly through the inlet opening at the bottom of the bag. This adapter tube is coupled to the baffle system, which comprises a generally triangular or conical frame having a substantially rigid, apertured upper surface that extends generally parallel to the bottom wall of the garment bag, and at least one generally rigid, apertured side wall that connects the upper surface to the adapter tube. The upper surface and the at least one side wall define a heated air chamber in which warm or hot air from the dryer collects before passing through the baffle into the clothing compartment.

BRIEF DESCRIPTION OF THE DRAWINGS

The foregoing and more specific objects and advantages of the instant invention will become readily apparent to those skilled in the art from the following detailed description of the preferred embodiments thereof taken in conjunction with the drawings in which.

DETAILED DESCRIPTION OF EXEMPLARY EMBODIMENTS

Figure 1:
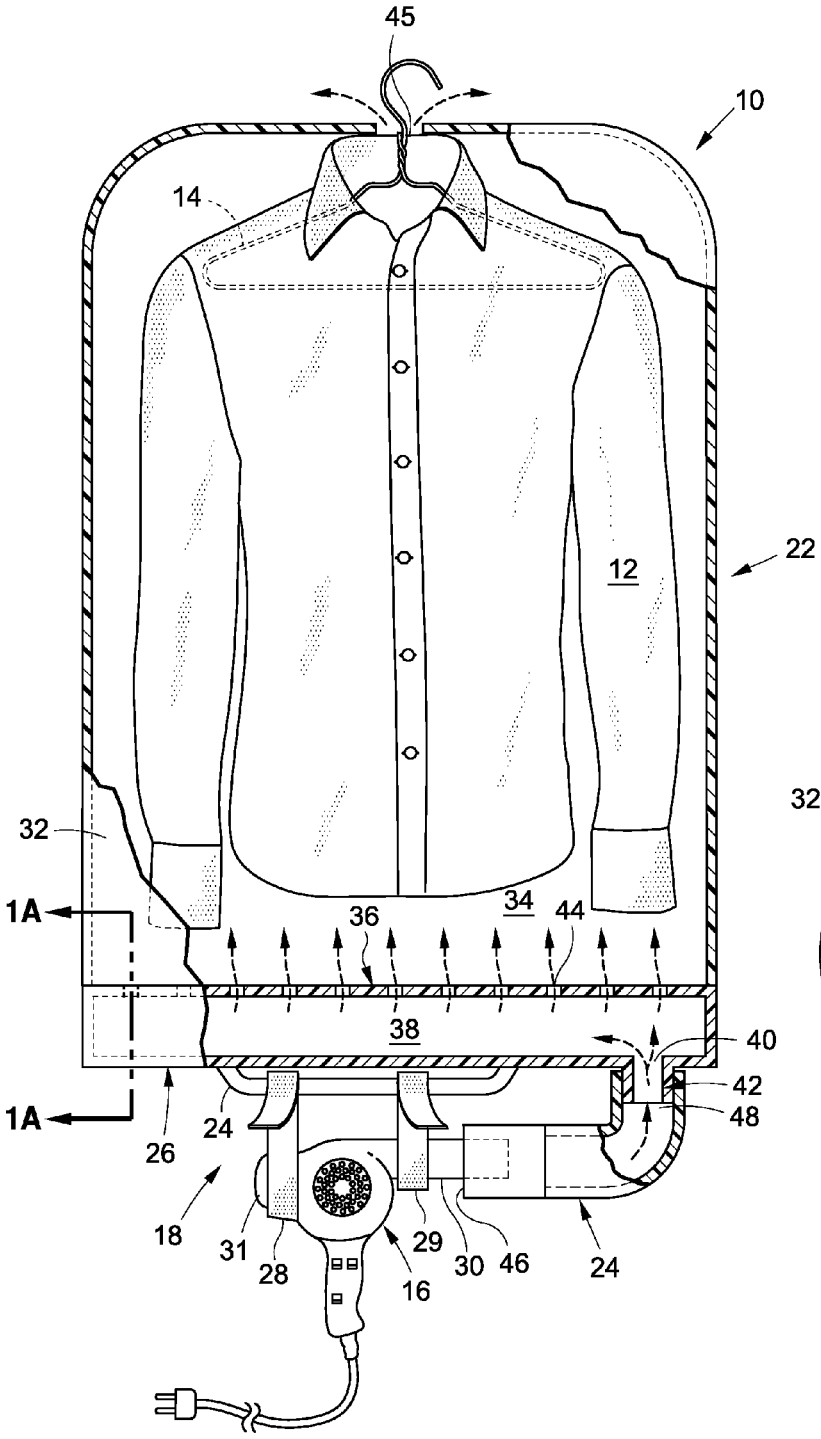
FIG. 1 is a front view, partially broken away, demonstrating the use of a portable clothes drying assembly according to a first preferred embodiment of the invention.

Turning now to the drawings, in which like numerals indicate corresponding elements throughout the several views, attention is first directed to FIG. 1, showing the portable drying assembly of the present invention, indicated in its entirety by the numeral 10, being used to dry a shirt 12 suspended from a conventional clothes hanger 14. The assembly 10 comprises a conventional hand held hair dryer 16, a mounting assembly 18 for securing the hair dryer 16 in a relatively stationery position relative to the shirt, and an adapter tube 20 for directing heated air from the hair dryer 16 to the shirt 12.

More specifically, the mounting assembly 18 comprises a specially configured garment bag 22 having a crosspiece 24 secured to its bottom wall 26, and mounting straps 28, 29 configured to suspend the dryer 16 from the crosspiece. In the illustrated embodiment, the mounting straps are provided in the form of a pair of flexible straps having mating hook and loop type fasteners formed at their opposing ends. One of the straps 28 is looped around the nozzle 30 of the hair dryer 16, and the other strap 29, is looped around the rear portion 31 of the hair dryer, which typically houses the exhaust fan (not shown). However, other arrangements of straps or equivalent fasteners, which will be readily apparent to one of ordinary skill in the art, may be more appropriate for other configurations of hair dryers, and are intended to be included within the scope of this invention.

The garment bag 22, which is formed from a heat-resistant material, comprises a pair of side walls 32 defining a clothing compartment 34. An envelope having a heat resistant exterior wall 36 and a hollow interior defines a heated air chamber 38 above the bottom wall 26 of the garment bag 22. heated air enters the chamber 38 through an inlet opening 40 surrounded by a downwardly extending neck or attachment flange 42, and passes from the chamber 38 into the clothing compartment 34 via a plurality of vents 44 formed in the exterior wall 36. The heated air then exits the clothing compartment 34 through an outlet opening 45 at the top of the garment bag 22.

Figure 1A:
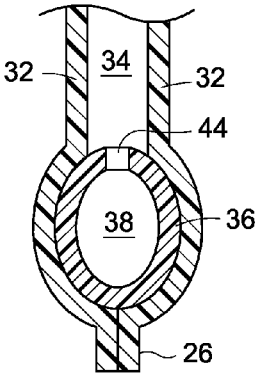
FIG. 1A is a sectional view taken through line A-A of FIG. 1.

Although the exterior wall 36 of the envelope is illustrated in FIG. 1A as being an elliptical cylindrical tube, other configurations can readily be envisioned. For instance, the exterior wall could also consist of a flat strip or sheet of material extending parallel to the bottom wall 32.

The adapter tube 20 is formed of heat-resistant material and includes a proximal end 46 and a distal end 48. The proximal end 46 is configured to sealingly engage or otherwise securely fit over or into the nozzle 30 of the hair dryer 16, while the distal end 48 is configured to sealingly engage with the attachment flange 42 depending from the bottom wall. The tube 20 may be formed from a flexible material allowing it to be easily bent or curved upwardly toward the attachment flange 42, or it may formed from a rigid material, with the distal end 48 extending at a fixed upward curve (at least 90 degrees and less than 180 degrees) with respect to the proximal end 46.

Figure 2:
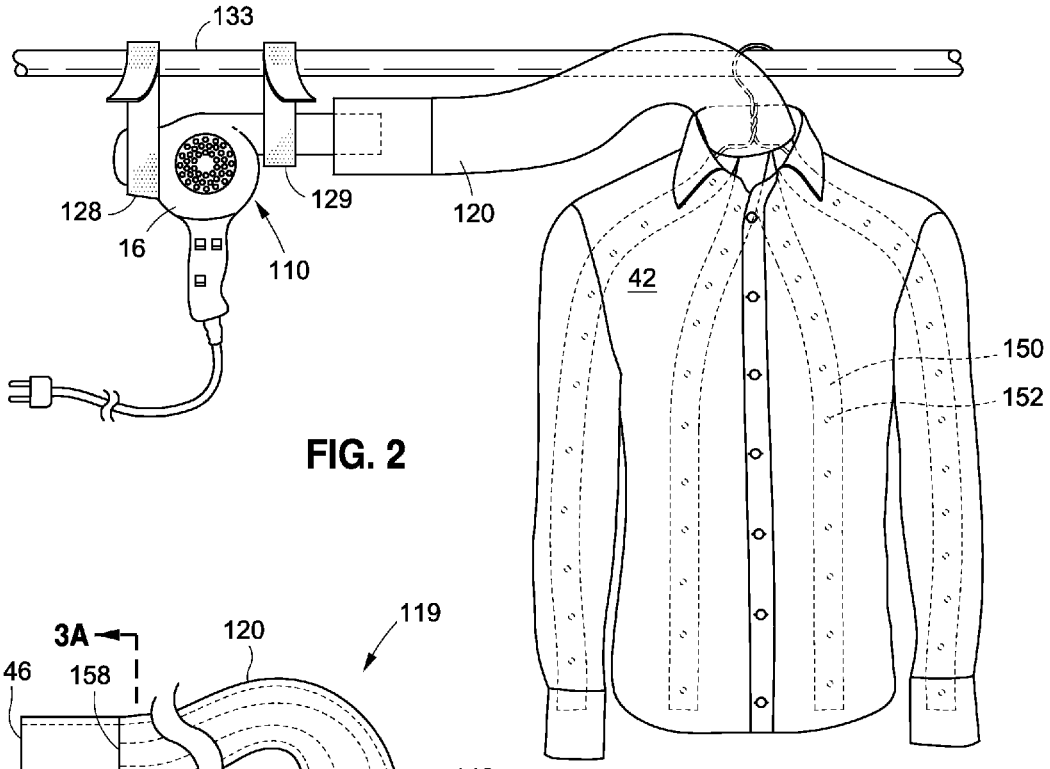
FIG. 2 is a front view, partially broken away, demonstrating the use of a portable clothes drying assembly according to a second preferred embodiment of the invention.
Figure 3:
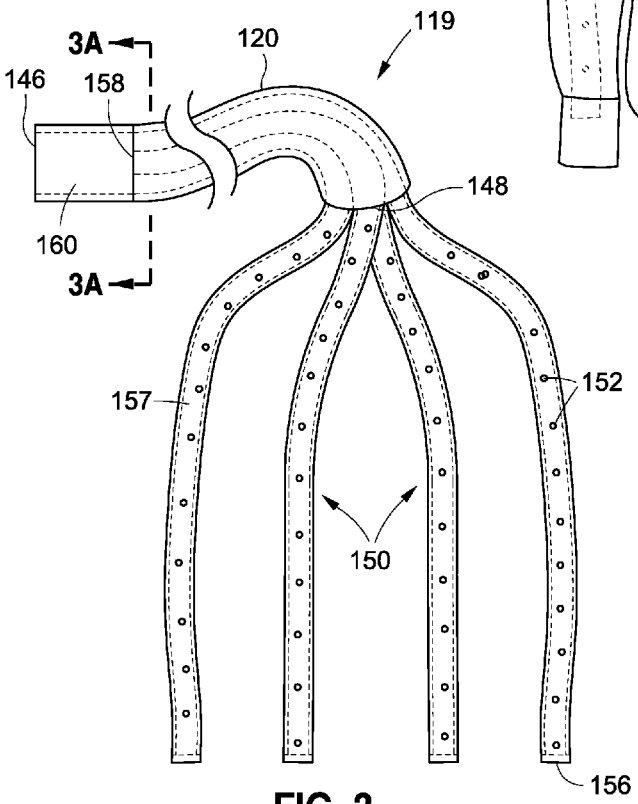
FIG. 3. is a front view showing an adapter assembly according to the embodiment of FIG. 2.
Figure 3A:
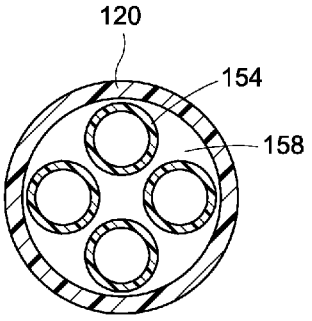
FIG. 3A is a sectional view taken through line A-A of FIG. 3.

An alternate preferred embodiment of the invention is illustrated in FIGS. 2 and 3. In this embodiment, indicated in its entirety by the numeral 110, the garment bag has been eliminated and the mounting means consists solely of flexible straps 128 and 129 for hanging the hair dryer 16 directly from a horizontally extending structure such as a clothing rod 133 in a closet. Furthermore, the adapter tube 20 of the previous embodiment has been replaced by an adapter assembly 119 comprising an adapter tube 120 and a plurality of distributor tubes 150 that extend longitudinally through the adapter tube 120.

Like its counterpart in the previous embodiment, the adapter tube 120 is formed of heat-resistant material and includes a proximal end 146 and a distal end 148. Unlike its counterpart however, the distal end 148 is intended to be free and need not conform to any particular dimensions or geometric configuration. If the tube 120 is formed from a flexible material, it may be bent or curved downwardly into an article of clothing such as a shirt 12 hanging from the same horizontal rod 133 as the dryer 16. Alternatively, if the tube 120 is formed from a rigid material, the distal end 148 should extend at a fixed curve at least 90 degrees and less than 180 degrees) with respect to the proximal end 146.

The distributor tubes 150 may be formed of a flexible porous material such as cloth, or a flexible non-porous material such as heat-resistant vinyl having a number of apertures, perforations, or vents 152 formed along its length. Each tube 150 has an open proximal end 154, a closed distal end 156, and an intermediate portion 157 having a length substantially greater than the length of the adapter tube 120. The proximal end 154 of each tube 150 is held in an opening in a retaining disk 158 that is press-fit or otherwise securely retained downstream of the distal end 146 of the adapter tube 120. The space 160 between the retaining disk and distal end of the adapter tube 120 defines a heated air chamber where air from the dryer 16 collects before passing in concentrated streams through the distributor tubes 150. When the tubes 150 are extended through an article of clothing, as shown in FIG. 2, the heated air escapes through the pores or vents 152, and is distributed throughout article, allowing it to be dried quickly and efficiently.

The mounting and adapter means of the embodiments of FIGS. 1-3 may be provided in combination with any conventional blower-type hair dryer, or they may be provided separately in the form of conversion kits that the consumer can purchase in order to convert his or her own hair dryer (or a hotel dryer) into a clothes dryer. Given that a very large number of hair dryers are available in a wide variety of sizes and configurations, it is anticipated that minor modifications may be needed in both the mounting means and the adapter tube, in order to conform to the designs of the hair dryers. Such modifications could readily be envisioned and made by those skilled in the art without departing from the spirit of the present invention.

Figure 4:
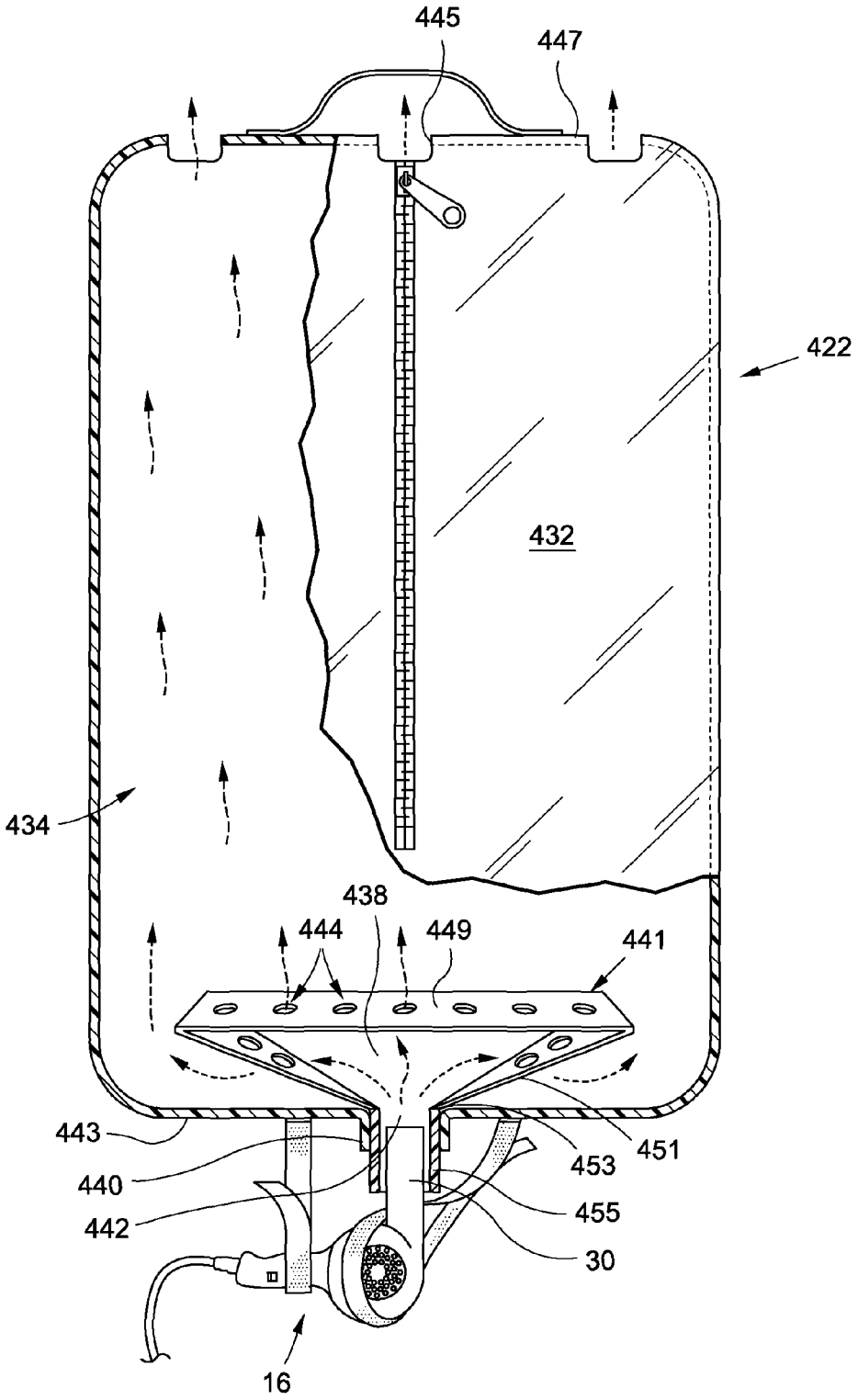
FIG. 4 is a front portion of a garment bag according to an alternate embodiment of the invention, with a portion broken away to show the interior of the bag.

FIG. 4 shows an embodiment of the invention wherein the blow dryer 16 may be used as-is, without the need for a separate adapter to be secured to its nozzle 30. This embodiment comprises a garment bag 422 having a pair of side walls 432 defining a clothing compartment 434. An inlet opening 442 having a downwardly extending neck 440 is formed at the bottom edge 443 of the bag 422. A plurality of exhaust openings 445 are formed in the upper edge 447 of the bag. The centermost of the exhaust openings 445 may be large enough for the hook of hanger (not shown) to extend through, and the remaining openings may be of approximately the same size as the centermost opening 445 or much smaller; ie. pin-sized.

The baffle system of this embodiment comprises a frame 441 having a substantially rigid upper apertured surface 449 that extends generally parallel to the bottom wall 443 of the garment bag, and at least one generally rigid, apertured side wall 451 that supports the upper surface 449 above the inlet opening 440. The frame 441 may be described as an inverted pyramid or as generally triangular, conical, or funnel-shaped in configuration. The space enclosed by the frame 441 is generally triangular in cross-section and defines a heated air chamber 438 that collects warm or hot air from a dryer 16 before the air exits through the apertures 444 in the baffle frame 441.

The lower end 453 of the baffle frame 441 is attached to an elongated adapter tube 455 that projects through the inlet opening 442 to receive the nozzle 30 of a dryer 16 supported in a nozzle-up position by flexible mounting straps 28, 29.

Although the clothes drying assemblies of the present invention are illustrated in use with a long-sleeved shirt, they may clearly be used, with or without modification, to dry other articles of clothing such as pants, dresses, shirts, and shoes, without departing from the spirit of the invention. Any variations in the basic design that are necessary to accommodate different types of clothing are intended to be included within the scope the invention, which is assessed only by a fair interpretation of the following claims.

Having fully described and disclosed the instant invention and a preferred embodiment thereof in such clear and concise terms as to enable those skilled in the art to understand and practice the same, the invention claimed is:

1. A garment bag for transporting an article of clothing suspended on a hanger, the garment bag comprising:

a) a pair of exterior side walls defining a clothing compartment;

b) an inlet opening configured to receive heated air from a blow dryer; and c) a baffle system provided above said inlet opening and configured to distribute heated air substantially evenly throughout the clothing compartment, the baffle system including i) a substantially rigid upper surface configured to extend over the inlet opening, ii) at least one substantially rigid side wall extending between the substantially rigid surface and the inlet opening, and configured to support the substantially rigid surface at a spaced location from the inlet opening, wherein the upper surface and the at least one side wall define a heated air chamber, and wherein the surface and at least one side wall include a plurality of spaced-apart apertures configured to allow the heated air to pass from the heated air chamber into the clothing compartment.

2. A garment bag according to claim 1, further comprising a neck encircling and projecting from said inlet opening.

3. A garment bag according to claim 2, wherein said neck is dimensioned and configured to receive and closely encircle a nozzle of the blow dryer.

4. A garment bag according to claim 2, wherein said neck is dimensioned and configured to project into a tubular adapter secured on the end of a nozzle of the blow dryer.

5. A garment bag according to claim 1, further comprising an attachment system secured to the exterior side walls of the bag and configured to support the blow dryer in a position enabling the dryer to direct heated air into the opening.

6. A garment bag according to claim 5, wherein the attachment system comprises at least one flexible strap configured to suspend the blow dryer below the bag.

7. A garment bag according to claim 1, further comprising at least one exhaust opening configured to allow the heated air to escape from the clothing compartment to the environment.

8. A garment bag according to claim 7, wherein the at least one exhaust opening comprises an opening sufficiently large to allow a hook portion of the hanger to project through the bag.

9. A garment bag according to claim 7, wherein the at least one exhaust opening comprises a plurality of vents formed in the bag.

10. A garment bag for transporting an article of clothing suspended on a hanger, the garment bag comprising:

a) a pair of exterior side walls defining a clothing compartment;

b) a top edge;

c) a handle secured to the top edge;

c) a bottom edge;

d) an inlet opening formed in the bottom edge and configured to receive heated air from a blow dryer; and f) an attachment system secured to the bottom edge of the bag and configured to support a blow dryer in a position enabling the dryer to direct heated air into the opening; and f) a baffle system provided above said inlet opening and configured to distribute heated air substantially evenly throughout the clothing compartment, the baffle system including i) a substantially rigid upper surface configured to extend over the inlet opening; and ii) at least one slanted rigid side wall extending between the substantially rigid upper surface and the inlet opening, and configured to support the substantially rigid upper surface at a spaced location from the inlet opening, wherein the upper surface and the at least one side wall define a heated air chamber having a generally triangular cross-section, and wherein the upper surface and at least one side wall include a plurality of spaced-apart apertures configured to allow the heated air to pass from the heated air chamber into the clothing compartment.

11. A garment bag according to claim 10, wherein the inlet opening is encircled by a neck configured to receive a nozzle of the blow dryer.

12. A garment bag according to claim 10, further comprising at least one exhaust opening configured to allow the heated air to escape from the clothing compartment to the environment.

13. A garment bag according to claim 12, wherein the at least one exhaust opening comprises a plurality of vents formed along the top edge of the garment bag.

14. A garment bag according to claim 10, wherein the attachment system comprises at least one flexible strap configured to suspend the blow dryer below the bag.

* * * * *